United States Patent [19]

Phillips

[11] 4,182,927

[45] Jan. 8, 1980

[54] ELECTRODE HOLDERS HAVING DIFFERENTIAL CLAMPING DEVICES

[75] Inventor: Donald L. Phillips, Birmingham, Ala.

[73] Assignee: Dixie Bronze Company, Birmingham, Ala.

[21] Appl. No.: 930,976

[22] Filed: Aug. 4, 1978

[51] Int. Cl.[2] ..... H05B 7/102

[52] U.S. Cl. ..... 13/16

[58] Field of Search ..... 13/14, 15, 16, 17

[56] References Cited

U.S. PATENT DOCUMENTS

| | | | |
|---|---|---|---|
| 2,148,834 | 2/1939 | Payne | 13/16 |
| 2,997,511 | 8/1961 | Turner | 13/15 |
| 3,334,170 | 8/1967 | Turner | 13/16 |
| 3,393,265 | 7/1968 | Vokac | 13/16 |
| 3,402,250 | 9/1968 | Turner | 13/16 |
| 3,444,305 | 5/1969 | Turner | 13/16 |
| 3,509,261 | 4/1970 | Phillips | 13/15 |
| 3,602,624 | 8/1971 | Turner et al. | 13/15 |
| 3,686,421 | 8/1972 | Wunsche et al. | 13/15 |

OTHER PUBLICATIONS

"Differential Clamping Device with Bellows"; an unfiled patent disclosure submitted as admitted prior art with this application.

*Primary Examiner*—Roy N. Envall, Jr.
*Attorney, Agent, or Firm*—Burmeister, York, Palmatier, Hamby & Jones

[57] ABSTRACT

An electrode holder for an electric arc furnace electrode, comprising a holder body having a cylindrically curved internal surface for engaging the electrode, a clamping shoe movable relative to the body and having a cylindrically curved portion for engaging the electrode, a piston having an axial rod member connected to the clamping shoe, cylinder means connected to the holder body and having a cylinder bore slidably receiving the piston, said cylinder bore having first and second chambers therein communicating with the opposite sides of the piston, the cylinder means having first and second port means for admitting fluid pressure to the respective first and second chambers, an axial guide shaft member on the piston and extending therefrom in a direction opposite from the direction of the rod member, the cylinder means having a guide opening therein slidably receiving and guiding the guide shaft member, and compression spring means mounted around the guide shaft member and compressed between the piston and the cylinder means for exerting a resilient biasing force on the piston for biasing the clamping shoe into clamping engagement with the electrode, the clamping engagement being released by fluid pressure supplied to the first chamber to move the piston in opposition to the spring means, the clamping force exerted by the clamping shoe being increased by fluid pressure supplied to the second chamber for exerting force on the piston to supplement the resilient force of the spring means. The spring means may comprise a stack of compressible curved spring discs having openings for slidably receiving the guide shaft member. The guide opening may be formed by a reduced guide bore in an end member of the cylinder means. A second piston may be connected coaxially in tandem with the first mentioned piston and may be slidable in a second cylinder bore in the cylinder means, to develop supplementary releasing and clamping forces.

21 Claims, 14 Drawing Figures

20
42
26
36
38
30
24
22
34

ELECTRODE HOLDERS HAVING DIFFERENTIAL CLAMPING DEVICES

This invention relates to electrode holders for the electrodes of electric arc furnaces.

One object of the present invention is to provide a new and improved electrode holder of the type which is adapted to be clamped to an electrode of an electric arc furnace, for supplying electrical current to the electrode.

A further object is to provide a new and improved electrode holder which includes spring means for clamping the holder to the electrode, so that the electrode holder is failsafe, in that the holder is normally clamped to the electrode, in the absence of operative means to release the holder.

Another object is to provide a new and improved electrode holder having a differential clamping device, including spring means for clamping the holder to the electrode, power operated releasing means for unclamping the holder from the electrode, and power operated clamping means for supplementing the clamping force developed by the spring means.

A further object is to provide a new and improved electrode holder of the foregoing character, in which the differential clamping device includes a double-acting fluid power cylinder, incorporating and combined with the spring means, so that the clamping force is provided by the spring means, supplemented by the application of fluid pressure to one side of a piston in the cylinder, while the releasing force is provided by the application of fluid pressure to the other side of the piston in the cylinder.

To achieve these and other objects, the present invention preferably provides an electrode holder, comprising a holder body having a cylindrically curved internal surface for engaging the electrode of the electric arc furnace or the like, a clamping shoe movable relative to the holder body and having a cylindrically curved portion for engaging the electrode, a piston having an axial rod member connected to the clamping shoe, cylinder means connected to the holder body and having a cylinder bore slidably receiving the piston. The cylinder bore having first and second chambers therein communicating with the opposite sides of the piston, the cylinder means having first and second port means for admitting fluid pressure to the respective first and second chambers, an axial guide shaft member on the piston and extending therefrom in a direction opposite from the direction of the rod member, the cylinder means having a guide opening therein slidably receiving and guiding the guide shaft member, and compression spring means mounted around the guide shaft member and compressed between the piston and the cylinder means for exerting a resilient biasing force on the piston for biasing the clamping shoe into clamping engagement with the electrode, the clamping engagement being released by fluid pressure supplied to the first chamber to move the piston in opposition to the spring means, the clamping force exerted by the clamping shoe being increased by fluid pressure supplied to the second chamber for exerting force on the piston to supplement the resilient force of the spring means.

The spring means may comprise a stack of compressible curved spring discs mounted around the guide shaft member, such discs having axial openings for slidably receiving the guide shaft member.

The guide opening may be in the form of a reduced coaxial bore, formed in an end member of the cylinder means.

A second coaxial piston may be connected in tandem to the first mentioned piston, for supplementing the releasing and clamping forces developed by the action of fluid pressure upon the first piston. The cylinder means may have a second cylinder bore for slidably receiving the second piston.

Further objects, advantages and features of the present invention will appear from the following description, taken with the accompanying drawings, in which.

As just indicated, FIGS. 1–11 illustrate an electrode holder 20, adapted to be clamped to a cylindrical electrode 22 for an electric arc furnace. The electrode holder 20 may be dimensioned for use with electrodes of any known or suitable size, such as 12 inches in diameter, for example. If desired, the electrode holder 20 may be made larger, for use with much larger electrodes. The electrode holder 20 is adapted to supply a large electrical current to the electrode 22.

Figure 11:
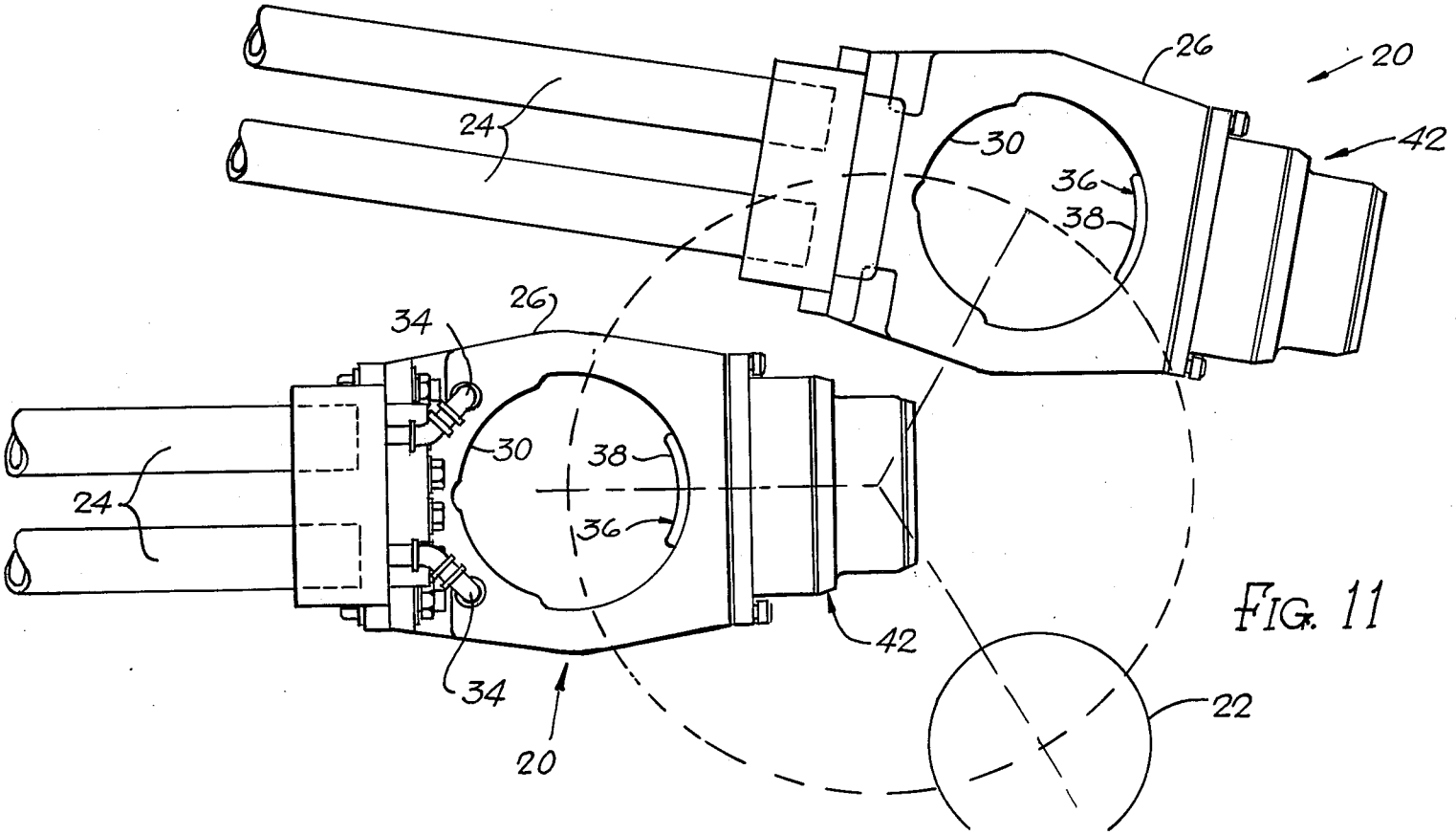
FIG. 11 is a diagrammatic plan view, indicating the positions of three electrode holders, for a typical electric arc furnace.

As shown in FIG. 11, a typical electric arc furnace has three of the electrodes 22. A separate electrode holder 20 is clamped to each of the electrodes 22. Typically, the electrode holders 20 are connected to the three terminals of a three-phase alternating current power supply, adapted to supply extremely large currents at a relatively low voltage. In the illustrated construction, a large current is supplied to each electrode holder 20 by its own pair of bus tubes 24, made of copper or some other highly conductive material. The bus tubes 24 are also generally employed to carry a coolant, such as cooling water, to and from the electrode holder 20.

The illustrated electrode holder 20 has a holder body 26 with an opening 28 for receiving the cylindrical electrode 22. Within the opening 28, the holder body has a cylindrically curved surface 30, adapted to be clamped against one side portion of the cylindrical electrode 22. Typically, the holder body 26 has coolant passages therein, not shown, for the circulation of the coolant, such as cooling water, through the body 26. A bracket structure 32 may be employed to connect the holder body 26 to the ends of the bus tubes 24. Pipe or tubing structures 34 may be employed to carry the coolant between the bus tubes 24 and the holder body 26, for the circulation of the coolant through the holder body. Preferably, the holder body 26 is made of a material, such as copper, for example, which is highly conductive to both electricity and heat. This applies particularly to the portion of the holder body which actually conducts the electrical current between the bus tubes 24 and the electrode 22.

The illustrated electrode holder 20 has a clamping shoe 36 which is movable relative to the holder body 26, into and out of clamping engagement with the electrode 22. The clamping shoe 36 has a cylindrically curved surface or portion 38 which is engageable with the cylindrical electrode 22. In this case, the clamping shoe 36 is movable in an opening 40 formed in the holder body 26.

The electrode holder 20 has a differential clamping device 42 for applying and releasing the clamping force between the clamping shoe 36 and the electrode 22. Such clamping force is exerted between the clamping shoe 36 and the holder body 26.

The illustrated clamping device 42 is adapted to be operated by fluid pressure, applied to a movable piston 44 having an axial piston rod 46 which is connected to the clamping shoe 36. In this case, a bolt 48 is employed to secure the clamping shoe 36 to the end of the piston rod 46, but any suitable connecting means may be employed. The illustrated piston rod 46 is tapped to receive the bolt 48.

Figure 1:
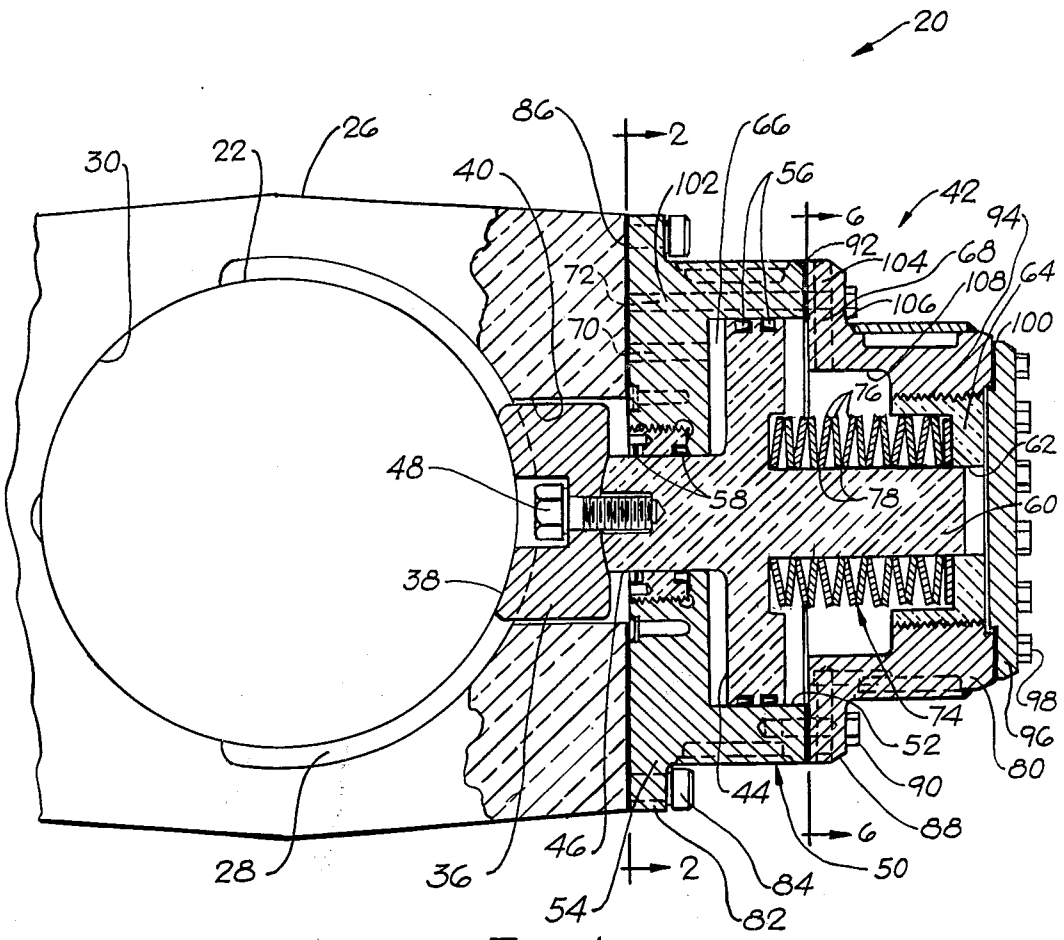
FIG. 1 is a plan view of an electrode holder to be described as an illustrative embodiment of the present invention, the view being partly in horizontal section.

As shown in FIG. 1, the piston 44 is slidable in cylinder means 50, comprising a cylinder bore 52 within a housing 54. Sealing means, such as the illustrated sealing rings 56, may be employed to provide a sliding seal between the piston 44 and the cylinder bore 52. The piston rod 46 is also preferably provided with a sliding seal, which may be afforded by the illustrated sealing rings 58.

The illustrated piston 44 is also provided with an axial guide shaft member 60, extending from the piston in the opposite direction, relative to the direction of the piston rod 46. The guide shaft member 60 is slidably received in guide means, such as the illustrated guide bore 62, formed in an end member 64 of the cylinder means 50.

The piston 44 divides the cylinder bore 52 into first and second chambers 66 and 68, in communication with the opposite sides of the piston 44. The cylinder means 50 may be provided with passage means 70 and 72 for supplying fluid pressure to the respective chambers 66 and 68, for the exertion of unclamping and clamping forces upon the piston 44. The passages 70 and 72 may be connected with other passages, not shown, in the holder body 26, adapted to be connected by suitable conduits to a fluid pressure control system for controlling the operation of the differential clamping device 42.

An initial clamping force is provided by spring means 74, preferably connected between the cylinder means 50 and the piston 44, for normally forcing the clamping shoe 36 against the electrode 22, in the absence of operative means for releasing the resilient clamping force. Thus, the clamping device 42 is fail-safe. The spring means 74 may be received around the guide shaft member 60 and may be compressed between the piston 44 and the end member 64 of the cylinder means 50. As shown, the spring means 74 are provided by a stack of spring discs 76 which are curved or cup-shaped and are resiliently compressible to provide a spring action. The illustrated spring discs 76 are formed with axial openings 78 for slidably receiving the guide shaft member 60. The length of the stack of spring discs 76 is such as to provide an initial resilient clamping force between the clamping shoe 36 and the electrode 22.

When fluid pressure is supplied to the first chamber 66 through the passage means 70, an unclamping or releasing force is exerted upon the piston 44, in opposition to the resilient force of the spring means 74. When the unclamping force exceeds the force of the spring means 74, the spring discs 76 are compressed, so that the clamping shoe 36 is moved away from the electrode 22. In this way, the electrode 22 is released, so that it can be slipped through the electrode holder 20. In the operation of the electric arc furnace, the electrodes 22 are gradually consumed. To compensate for this consumption, and to maintain the desired arc length, it is often the practice to slip the electrodes 22 through the electrode holders 20, periodically.

When the fluid pressure is vented from the chamber 66, the spring means 74 again provide a clamping force between the clamping shoe 36 and the electrode 22. This clamping force may be supplemented by supplying fluid pressure to the second chamber 68 through the passage means 72. The fluid pressure in the chamber 68 acts upon the piston 44 to provide a clamping force which adds to the resilient clamping force of the spring means 74. Thus, the electrode holder 20 is clamped to the electrode 22 with a greater degree of security, so that any slippage is prevented. Moreover, the electrical contact resistance between the holder body 26 and the electrode 22 is minimized.

The cylinder means 50 may assume various forms and, for example, may comprise the illustrated generally cylindrical housing member 54, previously referred to, and a second generally cylindrical housing member 80. The illustrated housing member 54 has a flange 82 which is adapted to be secured to the holder body 26 by a plurality of bolts 84, or other suitable fasteners. A sealing gasket 86 or the like may be provided between the housing member 54 and the holder body 26.

As illustrated, the second housing member 80 has a flange 88 which is secured to the housing member 54 by a plurality of bolts 90, or other suitable fasteners. A gasket 92 is provided between the flange 88 and the first housing member 54.

In this case, the end member 64 is threaded into the housing member 80 by suitable screw threads 94. The outer end of the housing member 80 is closed by a cover plate 96, secured to the housing member 80 by bolts 98 or other suitable fasteners. A gasket 100 or the like may be provided between the housing member 80 and the end plate 96.

As shown in FIG. 1, the fluid pressure passage 70 extends through the housing member 55, in a direction parallel to the axis of the cylinder bore 52. The fluid pressure passage 72 has a portion 102 extending through the housing member 54, a second portion 104 aligned with the portion 102 and extending into the second housing member 80, and a radial portion 106, extending in the housing member 80 between the portion 104 and a chamber 108 in the housing member 80. It will be seen that the chamber 108 opens into the chamber 68, to the right of the piston 44 in the cylinder bore 52. The passage portions 104 and 106 are shown to best advantage in FIG. 7.

Figure 2:
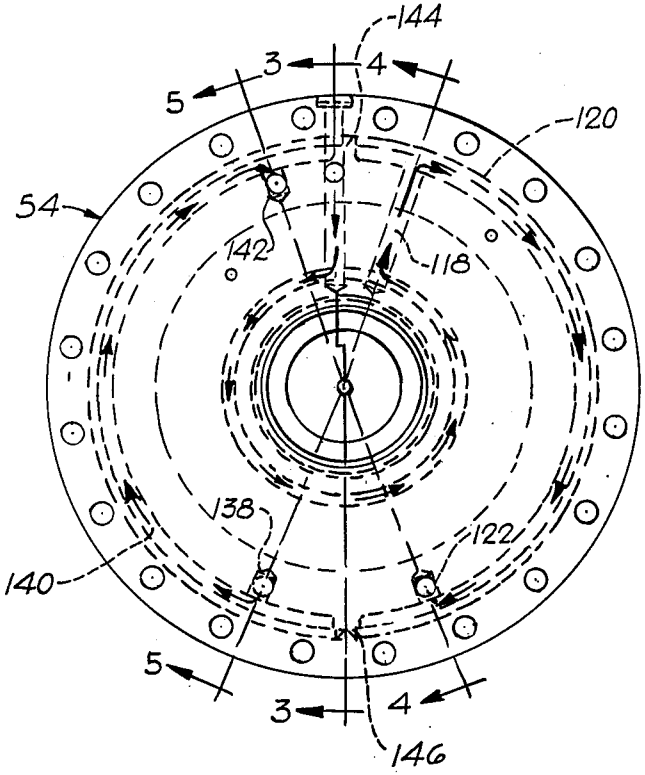
FIG. 2 is an end view of the differential clamping device, incorporated into the electrode holder of FIG. 1, the view being taken generally as indicated by the line 2—2 in FIG. 1.
Figure 6:
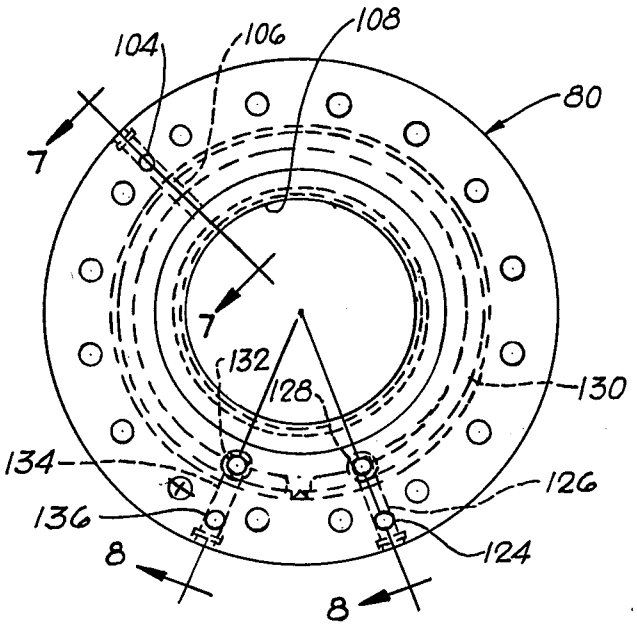
FIG. 6 is an end view of a housing member employed in the differential clamping device of FIGS. 1 and 2, the view being taken generally as indicated by the line 6—6 in FIG. 1.
Figure 7:
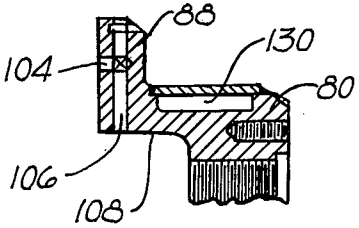
FIG. 7 is a fragmentary section, taken generally along the line 7—7 in FIG. 6.
Figure 8:
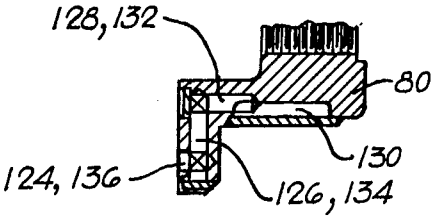
FIG. 8 is a fragmentary section, taken along either of the planes represented by the broken line 8—8 in FIG. 6.
Figure 3:
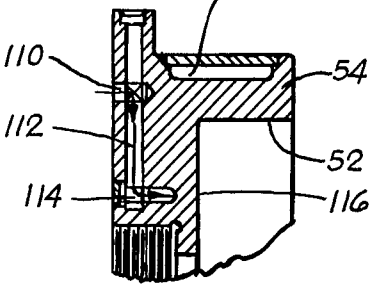
FIG. 3 is a fragmentary section, taken generally along the line 3—3 in FIG. 2.
Figure 4:
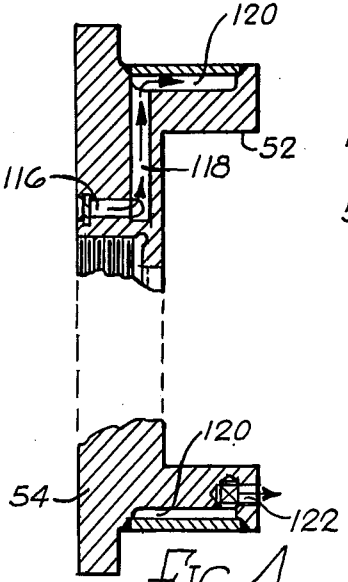
FIG. 4 is a fragmentary section, taken generally along the line 4—4 in FIG. 2.
Figure 10:
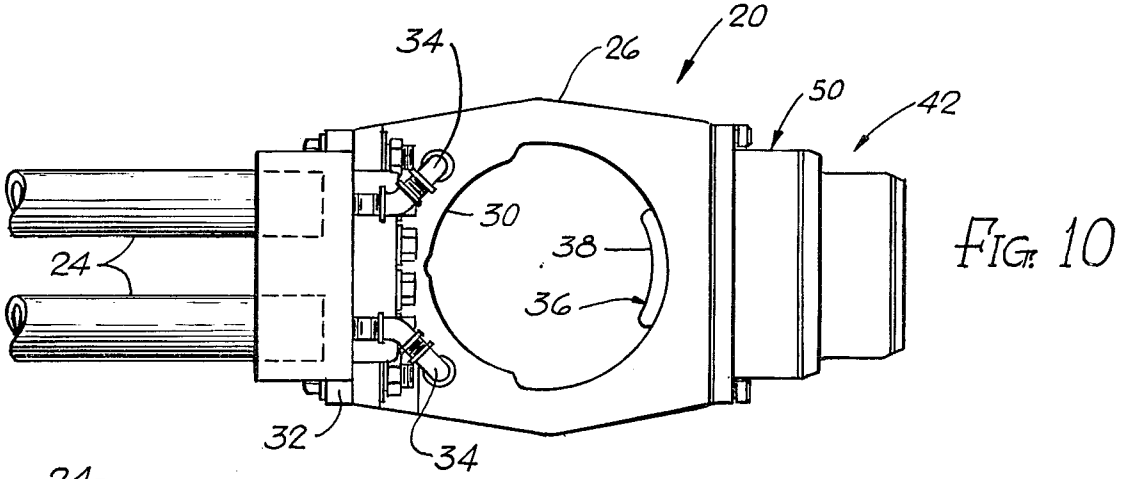
FIG. 10 is a plan view of the electrode holder of FIGS. 1–9.
Figure 9:
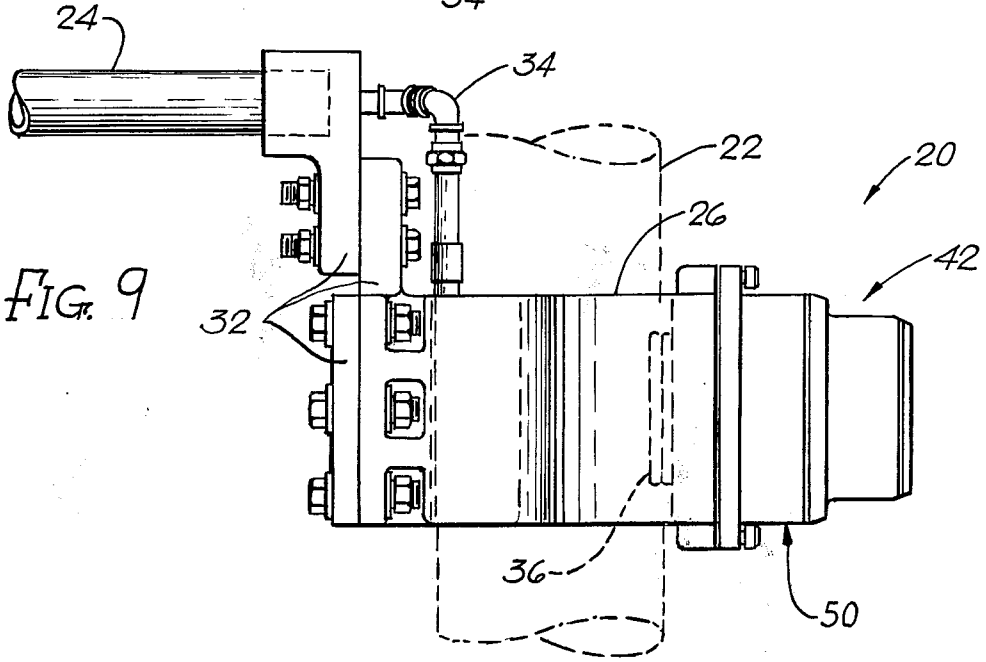
FIG. 9 is a side elevation of the electrode holder of FIGS. 1–8.

The housing members 54 and 80 are preferably formed with internal passages for the circulation of cooling water or some other coolant. The construction of the cooling passages may be varied. As shown in FIGS. 2 and 3, the coolant enters the housing member 54 through a longitudinal port 110 and then flows through a radial passage 112 and a longitudinal passage 114 into an annular passage 116. After passing through almost 360° around the annular passage 116, the coolant travels radially in an outward direction through a passage 118 into an annular passage 120, as shown in FIG. 4. The coolant passes through somewhat less than 180° through the annular passage 120, as shown in FIG. 2, and then passes out of the housing member 54 through a longitudinal port 122. The coolant then enters an aligned port 124 in the second housing member 80 and passes through a radial passage 126 and a longitudinal passage 128 into an annular passage 130, as shown in FIGS. 6 and 8. After travelling through somewhat less than 360°, around the annular passage 130, the coolant travels through a longitudinal passage 132, a radial passage 134, and a longitudinal exit port 136. It will be understood that FIG. 8 represents both sets of the ports 124 and 136, the radial passages 126 and 134, and the longitudinal passages 128 and 132.

Figure 5:
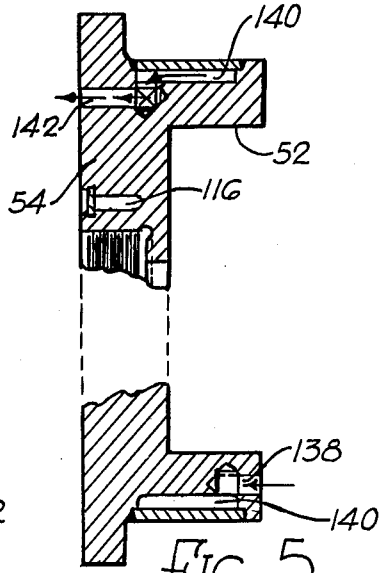
FIG. 5 is a fragmentary section, taken generally along the line 5—5 in FIG. 2.

The coolant from the exit port 136 reenters the first housing member 54 through an aligned port 138, as shown in FIG. 5. The coolant then passes around an annular passage 140, through somewhat less than 180°, and exits from the housing member 54 through a longitudinal port 142. The annular passage 140 is at the same radius as the passage 120 but is isolated from the passage 120 by barriers 144 and 146, as shown in FIG. 2.

It will be understood that the coolant is supplied to the port 122 and is carried away from the port 138 in the housing member 54 by coolant passages in the holder body 26. The circulation of the coolant prevents any excessive temperature from developing in the holder body 26 or the differential clamping device 42.

The guide shaft member 60 is slidable in the guide bore 62, so as to guide and stabilize the axial movement of the piston 44. The guide shaft member 60 also provides support and stability for the compression spring means 74. Such support and stability are particularly important for the proper operation of the compressible spring discs 76.

It will be understood that the differential clamping device 42 of FIGS. 1–11 may be operated by either gaseous or liquid fluid pressure. Thus, the fluid pressure may be developed by either compressed air or hydraulic fluid under pressure, for example.

An initial clamping force is provided by the spring means 74. This resilient clamping force pushes the piston 44 to the left, as shown in FIG. 1, so that the clamping shoe 36 is forced against the electrode 22.

The differential clamping device 42 may be constructed so that the spring means 74 will provide any suitable clamping force. For example, a particular electrode holder for a 10 inch electrode has been designed to provide a spring clamping force of 7000 pounds.

During normal operation of the electric arc furnace, the spring clamping force is supplemented by supplying fluid pressure to the chamber 68, on the right hand side of the piston 44, so that the fluid pressure develops an additional clamping force. The differential clamping device 42 may be designed to produce any suitable additional clamping force, produced by the fluid pressure. For example, the 10 inch electrode holder, previously mentioned, was designed to develop an additional clamping force of 11200 pounds when supplied with compressed air at 150 pounds per square inch. The total clamping force for this electrode holder was thus 7000 pounds plus 11200 pounds, making a total of 18200 lbs.

To release the clamping force, the chamber 68 is vented, and the fluid pressure is supplied to the chamber 66, on the left hand side of the piston 44. When the fluid pressure is sufficient to overcome the spring means 74, the piston 44 and the clamping shoe 36 are moved to the right, so that the clamping shoe no longer exerts a force against the electrode 22. The releasing force is the difference between the force developed by the fluid pressure and the force of the spring means 74.

Figures 12, 13:
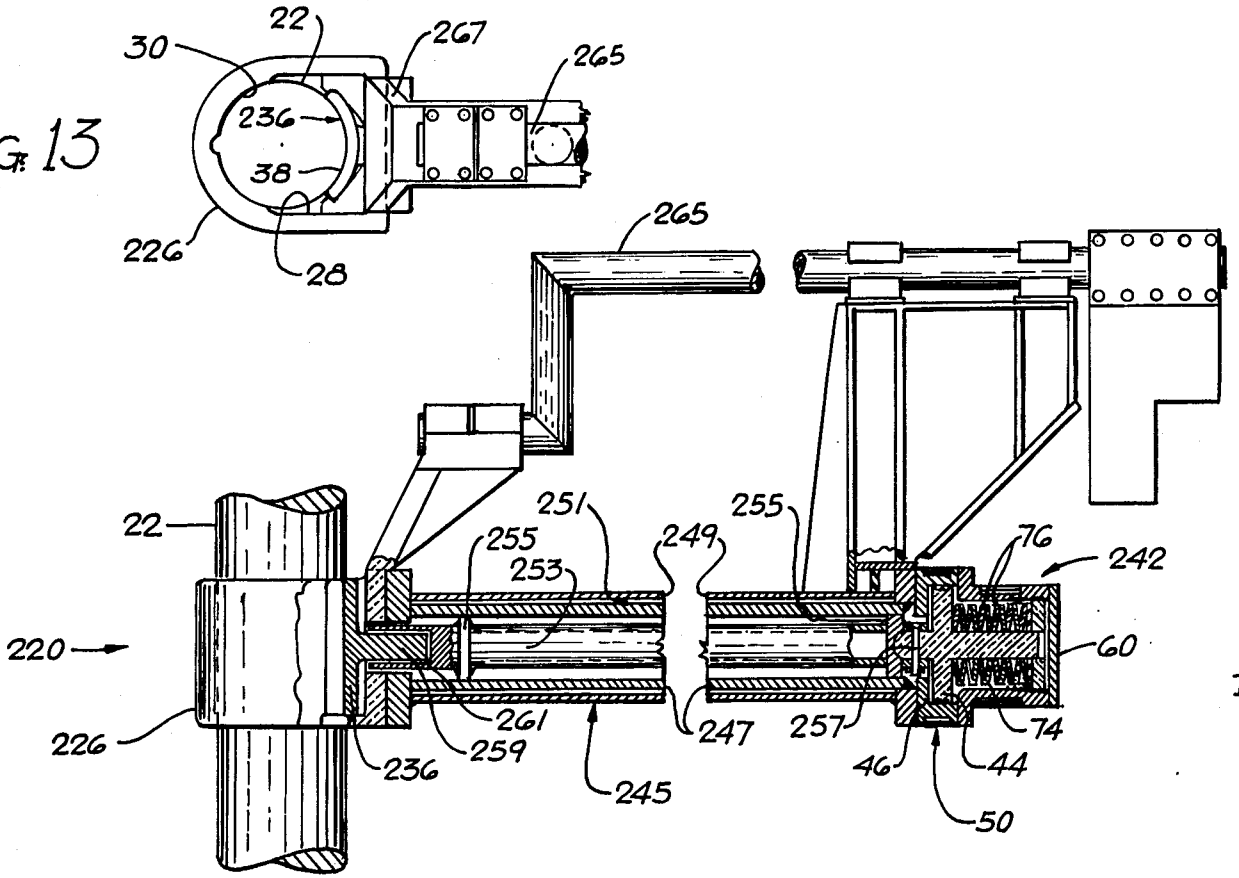
FIG. 12 is an elevational section showing a modified electrode holder, having a holder body and a differential clamping device which are mounted at the opposite ends of a mast arm.
FIG. 13 is a fragmentary plan view of the electrode holder shown in FIG. 12.

Many modified versions of the electrode holder may be employed. For example, FIGS. 12 and 13 illustrate a modified electrode holder 220, having a holder body 226 and a clamping shoe 236, similar to the corresponding components 26 and 36 of FIG. 1. Moreover, the electrode holder 220 has a differential clamping device 242 which may be essentially the same as the corresponding component 42 of FIG. 1. In FIGS. 12 and 13, the various elements of the holder body 226, the clamping shoe 236 and the differential clamping device 242 have been given the same reference characters as in FIGS. 1–11, so that the previous description will be fully applicable.

The electrode holder 220 of FIG. 12 differs from the previously described electrode holder, in that the holder body 226 and the differential clamping device 242 are mounted at the opposite ends of an elongated mast arm 245, which may assume various forms, but is illustrated as comprising inner and outer coaxial supporting tubes 247 and 249, with a space 251 therebetween, through which cooling water or some other coolant may be circulated. The piston rod 46 of the differential clamping device 242 is connected to the clamping shoe 236 by a push tube or member 253, disposed axially within the inner supporting tube 247. The push tube 253 transmits the clamping force from the piston rod 46 to the clamping shoe 236, so that the shoe may be clamped against the electrode 22, as before. The push tube 253 is movable axially within the inner supporting tube 247. As shown, the push tube 253 is provided with outwardly projecting circular discs or supports 255 which are slidable within the inner supporting tube 247.

The piston rod 46 is suitably secured to the inner or right hand end of the push tube 253, as shown in FIG. 12. In this case, the piston rod 46 is received within the end of the push tube 253 and is secured to the push tube by a transverse pin 257, extending through aligned openings in the piston rod 46 and the push tube 253.

The clamping shoe 236 is suitably secured to the opposite end of the push tube 253. As shown, the clamping shoe 236 has a stem or shank 259 which is received within the left hand end of the push tube 253. A layer of electrical insulation 261 may be provided between the push tube 253 and the shank 259.

The holder body 226 is adapted to supply an electrical current to the electrode 22. Electrical current is supplied to the holder body 226 by a bus tube 265, having its outer end connected to the holder body 226 by a bracket structure 267. If desired, the bus tube 265 may also be employed to supply cooling water or some other coolant to the holder body 226. The mast arm 245 and the push tube 253 may also be employed to supply the coolant to the holder body 226. The mast arm 245 may also be employed to supply the coolant to the differential clamping device 242.

The operation of the differential clamping device 242 is the same as in the case of the corresponding component 42 of FIGS. 1–11. As before, an initial clamping force is provided by the spring means 74. The spring clamping force is exerted between the cylinder means or body 50 and the piston 44, and is transmitted to the clamping shoe 236 by the push tube 253. The double acting fluid power cylinder, afforded by the piston 44 and the cylinder means 50, is employed to add to or overcome the initial clamping force exerted by the spring means 74. During normal operation of the electric arc furnace, fluid pressure is applied to the right hand side of the piston 44 to develop a supplementary clamping force which is added to the initial clamping force of the spring means 74.

When it is desired to release the clamping force, so that the electrode 22 can be slipped through the electrode holder 220, the fluid pressure is applied to the left hand side of the piston 44, while the right hand side is vented. The fluid pressure develops an unclamping force which exceeds the initial clamping force of the spring means 74, so that the piston 44 is moved to the right, to compress the spring means 74. The clamping shoe 38 is thus released from the electrode 22, so that it can be freely slipped through the opening in the electrode holder body 226.

Figure 14:
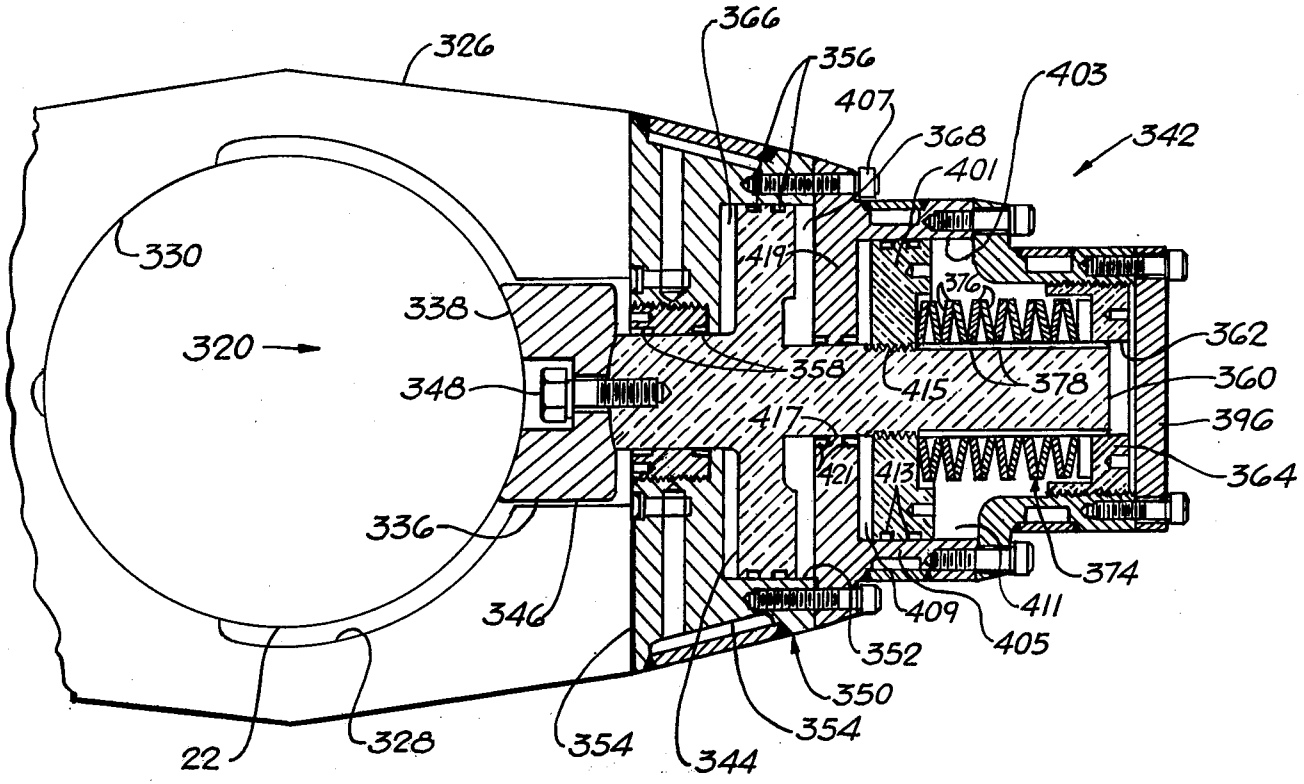
FIG. 14 is a fragmentary diagrammatic horizontal section, showing another modified electrode holder, incorporating two pistons which are connected in tandem.

By way of further example, FIG. 14 shows another modified electrode holder 320, comprising a holder body 326, a movable clamping shoe 336, and a differential clamping device 342, for moving the clamping shoe 336 into and out of clamping engagement with the electrode of an electric arc furnace or the like. Many of the components of the modified electrode holder 320 are essentially the same as in the case of the electrode holder 20 of FIGS. 1–11. To that extent, the components of the electrode holder 320 have been given the same reference characters, with the prefix 3, as employed in FIGS. 1–11, so that the previous description will be fully and readily applicable. Except as otherwise described, the corresponding components of the electrode holder 320 of FIG. 14 may be the same as described in connection with FIGS. 1–11.

The electrode holder 320 of FIG. 14 differs from the electrode holder 20 of FIGS. 1–11, in that the electrode holder 320 includes a second piston 401 which is connected in tandem with the first piston 344. In this way, greater clamping and unclamping forces can be developed, without any increase in the fluid pressure or the size of the piston 344. As shown, the second piston 401 is secured to the guide shaft member 360 and is slidable in a second cylinder bore 403, formed in an additional cylinder body or housing 405, aligned axially with the first cylinder body 354 and secured thereto by means of molds 407 or other suitable fasteners.

The piston 401 devides the cylinder bore 403 into first and second chambers 409 and 411, on opposite sides of the piston 401. Sealing rings 413 are provided on the piston 401, for slidable engagement with the cylinder bore 403.

Various means may be employed to mount the piston 401 on the guide shaft member 360. In this case, the piston 401 is secured to the guide shaft member 360 by suitable screw threads 415. This construction makes it easy to assemble the differential clamping device 342.

The guide shaft member 360 is slidable through a sealed opening 417 in a wall 419 on the housing member 405. Sealing rings 421 are provided to seal the opening 417. The wall 419 separates the chamber 409 from the chamber 368.

As before, the guide shaft member 360 supports the spring means 374 which may comprise the stacked spring discs 376. The stack of discs 376 is disposed between the second piston 401 and the end member 362.

As before, an initial clamping force is provided by the spring means 374, so that the clamping shoe 336 is clamped against the electrode 22.

During normal operation, the clamping force of the spring means 374 is supplemented by supplying fluid pressure to the chambers 368 and 411, through any suitable passages not shown. The fluid pressure in the chamber 368 causes the first piston 344 to develop a supplemental clamping force, which is added to the clamping force of the spring means 374. The fluid pressure in the chamber 411 causes the second piston 401 to develop additional clamping force which is added to the clamping forces produced by the spring means 374 and the first piston 344.

When the clamping shoe 336 is to be unclamped from the electrode 22, the chambers 368 and 411 are vented, and the fluid pressure is supplied to either or both of the chambers 366 and 409. The fluid pressure causes either or both of the pistons 344 and 401 to develop unclamping forces which overcome the force of the spring means 374, so that the clamping shoe 336 is moved away from the electrode 22.

It will be understood that a large total clamping force is desirable, in order to minimize the electrical contact resistance between the electrode 22 and the holder body 326. Moreover, a large clamping force ensures that there will be no movement between the electrode 22 and the electrode holder 320. The tandem piston construction of FIG. 14 provides an enhanced clamping force, without any increase in the fluid pressure, or in the size of the first piston. The electrode holder of FIG. 14 provides a particularly compact construction, for use when unusually large clamping forces are desired.

It will be understood, as to the various embodiments, that the piston, the piston rod member and the guide shaft member constitute piston means and that the spring means are connected between the piston means and the cylinder means. The electrode holder body and the clamping shoe may be regarded as first and second relatively movable elements of the electrode holder. The differential clamping device produces a clamping force between such elements. In some cases, there can be a reversal of parts between the first and second holder elements.

In the embodiment of FIGS. 12 and 13, the piston rod member is connected to the clamping shoe by the push tube. In the embodiment of FIG. 14, the piston means also include the second piston.

I claim:

1. An electrode holder for an electric arc furnace electrode, comprising a holder body having a cylindrically curved internal surface for engaging the electrode, a clamping shoe movable relative to said body and having a cylindrically curved portion for engaging the electrode, a piston having an axial rod member connected to said clamping shoe, cylinder means connected to said body and having a cylinder bore slidably receiving said piston, said cylinder bore having first and second chambers therein communicating with the opposite sides of said piston, said cylinder means having first and second port means for admitting fluid pressure to said respective first and second chambers, an axial guide shaft member on said piston and extending therefrom in a direction opposite from the direction of said rod member, said cylinder means having a guide opening therein slidably receiving and guiding said guide shaft member, and compression spring means mounted around said guide shaft member and compressed between said piston and said cylinder means for exerting a resilient biasing force on said piston for biasing said clamping shoe into clamping engagement with the electrode, said clamping engagement being released by fluid pressure supplied to said first chamber to move said piston in opposition to said spring means, the clamping force exerted by said clamping shoe being increased by fluid pressure supplied to said second chamber for exerting force on said piston to supplement the resilient force of said spring means.

2. An electrode holder according to claim 1, in which said compression spring means comprise a stack of compressible cup shaped discs having openings for receiving said guide shaft member.

3. An electrode holder according to claim 1, said cylinder means including an end member having a guide bore therein forming said guide opening, said guide bore being reduced relative to said cylinder bore.

4. An electrode holder according to claim 1, said cylinder means having an end member with a reduced axial guide bore therein forming said guide opening, said spring means comprising a stack of compressible curved discs compressed between said piston and said end member, said discs having axial openings for slidably receiving said guide shaft member.

5. An electrode holder according to claim 1, including a second piston coaxial with said first mentioned piston, and means connecting said second piston to said first mentioned piston in tandem therewith, said cylinder means having a second cylinder bore slidably receiving said second piston, said second cylinder bore having a pair of chambers therein communicating with the opposite sides of said second piston for receiving fluid pressure to supplement the releasing and clamping action of said first mentioned piston.

6. An electrode holder according to claim 5, in which said second piston is secured to said guide shaft member.

7. An electrode holder according to claim 5, including sealing means for sealing said second cylinder bore separately from said first mentioned cylinder bore.

8. A differential clamping device, comprising piston means including a piston and an axial rod member projecting in one direction from said piston, cylinder means having a cylinder bore slidably receiving said piston, said cylinder bore having first and second chambers therein communicating with the opposite sides of said piston, said cylinder means having first and second port means for admitting fluid pressure to said respective first and second chambers, an axial guide shaft member on said piston means and extending from said piston in a direction opposite from the direction of said rod member, said cylinder means having a guide opening therein slidably receiving and guiding said guide shaft member, and compression spring means mounted around said guide shaft member and compressed between said piston means and said cylinder means for exerting a resilient clamping force on said piston, said clamping force being overcome by fluid pressure supplied to said first chamber to move said piston in opposition to said spring means, said clamping force being increased by fluid pressure supplied to said second chamber for exerting force on said piston to supplement the resilient force of said spring means.

9. A device according to claim 8, in which said compression spring means comprise a stack of compressible cup shaped discs having openings for slidably receiving said guide shaft member.

10. A device according to claim 8, said cylinder means including an end member having a guide bore therein forming said guide opening, said guide bore being reduced relative to said cylinder bore.

11. A device according to claim 8, said cylinder means having an end member with a reduced axial guide bore therein forming said guide opening, said spring means comprising a stack of compressible curved discs compressed between said piston and said end member, said discs having axial openings for slidably receiving said guide shaft member.

12. A device according to claim 8, including a second piston coaxial with said first mentioned piston, and means connecting said second piston to said piston means in tandem with said first-mentioned piston, said cylinder means having a second cylinder bore slidably receiving said second piston, said second cylinder bore having a pair of chambers therein communicating with the opposite sides of said second piston for receiving fluid pressure to supplement the releasing and clamping action of said first-mentioned piston.

13. A device according to claim 12, in which said second piston is secured to said guide shaft member.

14. A device according to claim 12, including sealing means for sealing said second cylinder bore separately from said first mentioned cylinder bore.

15. An electrode holder for an electric arc furnance electrode, comprising first and second relatively movable holder elements for clamping engagement with the electrode, piston means including a piston and an axial rod member extending in one direction from said piston and connected to one of said holder elements, cylinder means connected to the other of said holder elements and having a cylinder bore slidably receiving said piston, said cylinder bore having first and second chambers therein communicating with the opposite sides of said piston, said cylinder means having first and second port means for admitting fluid pressure to said respective first and second chambers, an axial guide shaft member on said piston means and extending from said piston in a direction opposite from the direction of said rod member, said cylinder means having a guide opening therein slidably receiving and guiding said guide shaft member, and compression spring means mounted around said guide shaft member and compressed between said piston means and said cylinder means for exerting a resilient biasing force on said piston for biasing said holder elements into clamping engagement with the electrode, said clamping engagement being released by fluid pressure supplied to said first chamber to move said piston in opposition to said spring means, the clamping force exerted by said spring means being increased by fluid pressure supplied to said second chamber for exerting force on said piston to supplement the resilient force of said spring means.

16. An electrode holder according to claim 15, in which said compression spring means comprise a stack of compressible cup shaped discs having openings for slidably receiving said guide shaft member.

17. An electrode holder according to claim 15, said cylinder means including an end member having a guide bore therein forming said guide opening, said guide bore being reduced relative to said cylinder bore.

18. An electrode holder according to claim 15, said cylinder means having an end member with a reduced axial guide bore therein forming said guide opening, said spring means comprising a stack of compressible curved discs compressed between said piston means and said end member.

said discs having axial openings for slidably receiving said guide shaft member.

19. An electrode holder according to claim 15, including a second piston coaxial with said first mentioned piston, and means connecting said second piston to said piston means in tandem with said first mentioned piston, said cylinder means having a second cylinder bore slidably receiving said second piston, said second cylinder bore having a pair of chambers therein communicating with the opposite sides of said second piston for receiving fluid pressure to supplement the releasing and clamping action of said first mentioned piston.

20. An electrode holder according to claim 19, in which said second piston is secured to said guide shaft member.

21. An electrode holder according to claim 19, including sealing means for sealing said second cylinder bore separately from said first mentioned cylinder bore.

* * * * *